US006478405B2

(12) United States Patent
Boerstal et al.

(10) Patent No.: US 6,478,405 B2
(45) Date of Patent: Nov. 12, 2002

(54) PRINTER

(75) Inventors: Hendricus G. J. Boerstal, Helden (NL); Paul Ewald Hilkens, Roermond (NL); Jeroen J. G. Coenen, Sevenum (NL)

(73) Assignee: OCE Technologies B.V., Venlo (NL)

( * ) Notice: Subject to any disclaimer, the term of this patent is extended or adjusted under 35 U.S.C. 154(b) by 0 days.

(21) Appl. No.: 09/907,913

(22) Filed: Jul. 19, 2001

(65) Prior Publication Data

US 2002/0018098 A1 Feb. 14, 2002

(30) Foreign Application Priority Data

Aug. 10, 2000 (NL) ..... 1015905

(51) Int. Cl.[7] ..... B41J 2/23; B41J 29/393
(52) U.S. Cl. ..... 347/43; 347/19
(58) Field of Search ..... 347/8, 16, 43, 347/14, 19

(56) References Cited

U.S. PATENT DOCUMENTS 4,688,050 A 8/1987 Tsao ..... 347/171
5,168,291 A 12/1992 Hiramatsu et al. ..... 347/19
5,771,050 A 6/1998 Gielen ..... 347/19

FOREIGN PATENT DOCUMENTS

EP 0693382 1/1996

OTHER PUBLICATIONS

Patent Abstracts of Japan, vol. 2000, No. 3 & JP 11 334149 (Dec. 7, 1999).
Patent Abstracts of Japan, vol. 017, No. 694 & JP 05238004 (Sep. 17, 1993).
Patent Abstracts of Japan, vol. 010, No. 202 & JP 61 043735 (Mar. 3, 1986).

*Primary Examiner*—Lamson Nguyen
(74) *Attorney, Agent, or Firm*—Biarch, Stewart, Kolasch & Birch, LLP

(57) ABSTRACT

The present invention relates to a printer comprising a printhead fixed on a scanning carriage, movement structure to move the scanning carriage and a receiving material with respect to one another in a main scanning direction and a sub-scanning direction, substantially perpendicularly to the main scanning direction, and a guide structure to guide the scanning carriage in the main scanning direction. The printer also comprises a displacement structure to displace the scanning carriage automatically with respect to the guide structure during the movement of the scanning carriage in the main scanning direction.

8 Claims, 3 Drawing Sheets

PRINTER

BACKGROUND OF THE INVENTION

The present invention relates to a printer containing a printhead fixed on a scanning carriage, movement means for moving the scanning carriage and a receiving material with respect to one another in a main scanning direction and a sub-scanning direction substantially perpendicularly to the main scanning direction, and a guide means for guiding the scanning carriage in the main scanning direction.

A printer of this kind is known from U.S. Pat. No. 5,771,050. The movement means in this known printer comprises a roller for displacing a receiving material, for example a sheet of paper, with respect to the printhead in the sub-scanning direction. The scanning carriage is displaced in the main scanning direction over a set of guide rods using a conveyor belt. The printhead of this printer comprises a linear row of inkjet print elements extending in the sub-scanning direction so that a plurality of pixel rows can be printed during a scanning pass of the scanning carriage in the main scanning direction. In order to avoid visible printing artifacts as much as possible, the known printer is equipped with a means for adjusting, prior to each scanning pass, the position that the printhead and the receiving material occupy with respect to one another in the sub-scanning direction. Such a means comprises a sensor disposed on the printhead in order to detect a registration mark provided on the receiving material. In addition, suche means include actuators for changing the position of the printhead with respect to the receiving material in dependence on a signal delivered by the sensor. After each scanning pass, a registration mark is printed on the receiving material, using the printhead. The receiving material is then displaced in the sub-scanning direction. If the receiving material is displaced over the correct distance, the sensor will detect the registration mark at a predetermined location, thus ensuring that the distance between the new rows of pixels for printing and the printhead pixel rows is correct. However, if the receiving material is not moved over the correct distance, the sensor will detect a deviation between the measured location and the predetermined location of the registration mark. The consequence is that a signal is delivered to displace the printhead with respect to the scanning carriage in the sub-scanning direction until the printhead occupies the proper position with respect to the receiving material. A number of pixel rows are then printed in a following scanning pass, whereafter a new registration mark is printed on the receiving material.

This known printer has a significant disadvantage. Despite the accurate adjustment of the printhead with respect to the receiving material prior to each scanning pass, it has been found that visible printing artifacts can occur, and these printing artifacts are not the result of a breakdown or other incorrect operation of one of the print elements of the printhead. These artifacts may depend inter alia on the printer loading and the ambient conditions.

SUMMARY OF THE INVENTION

The object of the present invention is to provide a printer which avoids such artifacts as far as possible. To this end, the printer is provided with a displacement means for displacing the scanning carriage automatically with respect to the guide means during a movement of the scanning carriage in the main scanning direction. The displacement means can be any means suitable to displace the scanning carriage, such as, for example, means that displace the carriage in contact, such as mechanical means (e.g., with the aid of a spring, screw, push or pull element, by means of expansion or shrinkage of an actuator, etc.) or in non-contact such as by magnetic or other forces that do not need a tangible intermediate (e.g., gravitational forces, centrifugal forces, etc.). It has been found that a considerable proportion of printing artifacts can be avoided in this way. It is not completely clear where such printing artifacts originate, but closer examination shows that there are a number of sources of error which can be reduced to inaccurate guidance of the scanning carriage over the guide means during a movement of the scanning carriage. Thus it is possible that the scanning carriage may move with respect to the guide means, for example, become slightly skewed, during the scanning movement. It is also possible that the guide means itself, for example a guide rod or set of guide rods, is not completely straight. It has been found that guide rods of this kind, which initially are frequently very straight, may become curved to a greater or lesser degree after assembly in the printer, due to thermal or mechanical stresses. These curvatures may in some cases be of a permanent nature. The separate deviations are often minor but the result of all these deviations together is that pixels are perceptibly printed at incorrect positions so that visible printing artifacts may occur. By providing the printer with a displacement means for displacing the scanning carriage automatically, i.e. by the printer itself, during a scanning pass, with respect to the guide means, all these deviations can be corrected. As a result, pixels are printed in the correct position so that printing artifacts can be avoided. An additional advantage of the printer according to the present invention is that it requires much less accurate mechanical adjustments. Deviations in the scanning carriage guidance can always be corrected by displacing the scanning carriage. This results in a saving of production costs for the printer. In addition, use can be made of less accurate and hence cheaper guide means, for example a set of relatively thin rods, without these being supported by a support surface which has had after-treatment, as adequately known from the prior art.

In one preferred embodiment, the scanning carriage is displaceable in the sub-scanning direction. This embodiment has the advantage that it is possible to prevent all the printing artifacts which cannot be corrected by adjusting the print time of the print elements. In this way it is possible to print good images with a relatively simple printer.

In a further preferred embodiment, the scanning carriage is displaceable in such manner that it occupies a substantially constant position as considered in the sub-scanning direction. Since the position of the scanning carriage in the sub-scanning direction remains substantially constant during the movement of the scanning carriage in this embodiment, the position of the scanning carriage with respect to the receiving material also remains substantially constant in that direction. In this way the printhead fixed on the scanning carriage will also occupy a substantially constant position, at least in the sub-scanning direction, with respect to the receiving material, during the movement of the scanning carriage in the main scanning direction. This further prevents, in a simple manner, visible printing artifacts from forming in a printed image.

In one preferred embodiment, at least two heads are fixed on the scanning carriage. In this embodiment the invention offers the further advantage that correction for both heads takes place simultaneously simply by displacing the scanning carriage with respect to the guide means. This is a relatively inexpensive way of correcting in one operation a considerable number of deviations which can lead to printing artifacts, for all the printing heads fixed on the scanning carriage.

In a further preferred embodiment, the printer is adapted to print wide-format receiving materials. In the case of wide-format receiving materials, i.e. materials wider than A4, a scanning carriage is moved over a relatively considerable distance. As a result, the printer is more sensitive to deviations in the guide mechanism. Here the invention offers the specific advantage that even in the case of very wide formats, such as A0, these deviations have no adverse effects on the image quality, because they can be corrected using the displacement means.

In one embodiment, the displacement means comprises two actuators operatively connected to the scanning carriage and the guide means. In this embodiment, a printer according to the invention is obtained in a simple manner. If the two actuators are connected to two ends of the scanning carriage in the main scanning direction a maximum displacement of the scanning carriage is possible. The actuator may be any electromechanical aid, including electromagnetic, magnetostrictive, pneumatic or hydraulic actuators. Preferably, however, use is made of piezo-electric actuators, because they respond relatively quickly, have a stable deflection, and a substantially linear volt/deflection characteristic, which facilitates use in an electronic control circuit. Amongst the piezo-electric actuators, the ceramic multi-layer actuators (CMA's) are particularly suitable because they have a considerable deflection and only require a small actuation voltage.

In a further embodiment, the scanning carriage is displaceable, using the displacement means, in a direction substantially perpendicular to the main scanning direction and the sub-scanning direction. In this way, deviations in a third direction (substantially perpendicular to the receiving material) can also be corrected. Correction in this way instead of adjusting the printing time of each of the print elements offers the advantage that the data processing in the printer is subjected to less loading. In addition, in this way irregularities in the receiving material, for example as a result of deviations in the feed surface or corrugations in the receiving material itself, can be corrected.

In a further preferred embodiment, a printhead is releasably fixed on the scanning carriage. In this embodiment, in which the printhead is replaceable, the invention offers the further advantage that no further adjustment means need to be integrated in the releasable fixing of the printhead. If, for example, the printhead has to be displaced in the sub-scanning direction because the receiving material has been incorrectly transported, this can be effected in principle also with the aid of the displacement means according to this invention. In principle it is possible to perform this and/or other small corrections with a correction means with which the position of the printhead with respect to the scanning carriage is controlled, for example in the manner known from the above-cited U.S. patent specification. The printer according to this latter embodiment, however, has the disadvantage that a complex adjustment means must be implemented for each printhead, and this is relatively expensive.

BRIEF DESCRIPTION OF THE DRAWINGS

The present invention will now be explained in detail with reference to the following drawings, wherein.

DETAILED DESCRIPTION OF THE INVENTION

Figure 1:
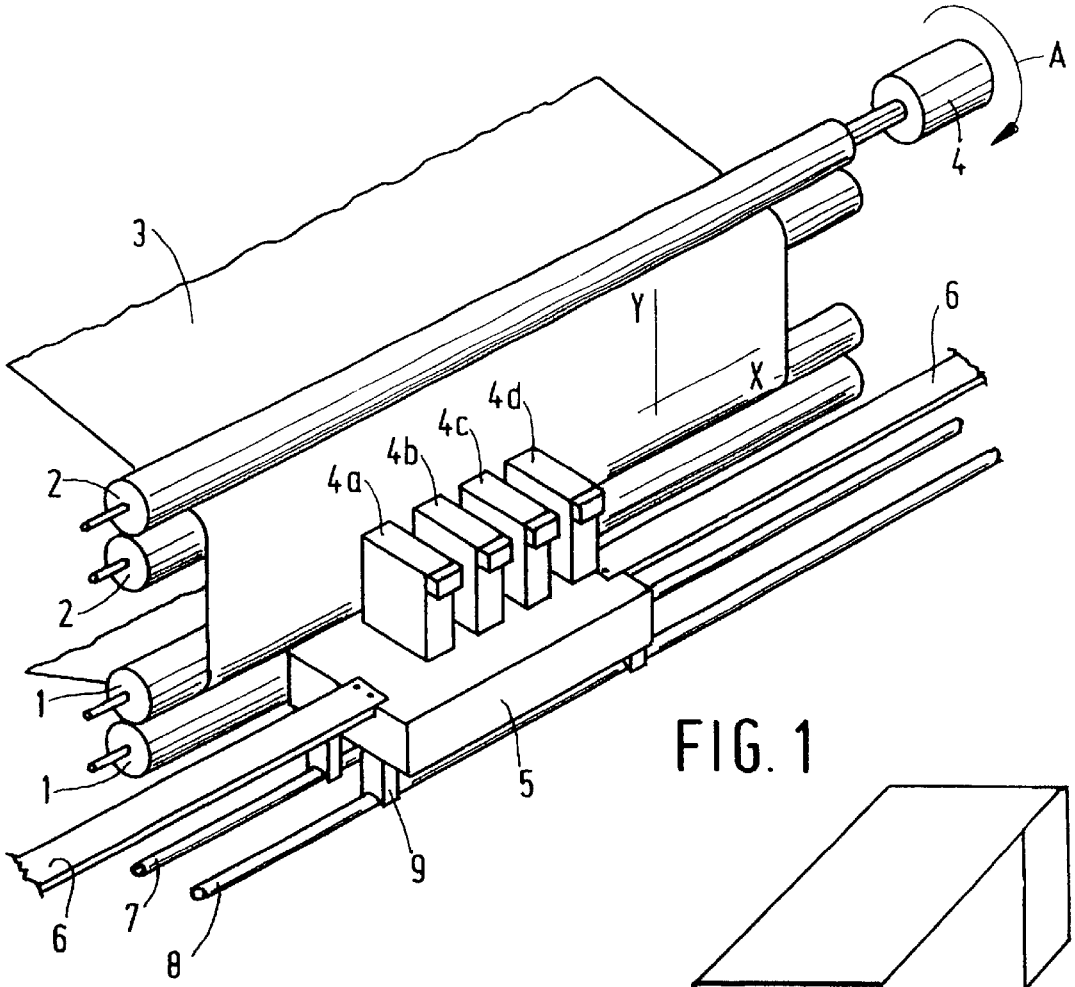
FIG. 1 is a diagram of an inkjet printer.

FIG. 1 diagrammatically illustrates an inkjet printer. In this embodiment, the printer comprises two pairs of rollers 1 and 2 for supporting a receiving material 3, for example a sheet of paper, and feeding it along four printheads 4*a,* 4*b,* 4*c* and 4*d* (each for one of the colors: black, cyan, magenta and yellow). Roller pair 2 is drivable by means of motor 4. In this case the top one of the two rollers is actively driven in a direction indicated by arrow A. As a result, the receiving material 3 can be displaced in the sub-scanning direction Y so that the receiving material can be moved with respect to the printheads. A scanning carriage 5 carries the four printheads 4*a,* 4*b,* 4*c* and 4*d* and can be moved in reciprocation in the main scanning direction X, parallel to the roller pairs 1 and 2. For this purpose, a conveyor belt 6 is fixed to the scanning carriage 5 so that the latter can be moved over the guide system formed by the rods 7 and 8. By the combination of the movement of the scanning carriage in the sub-scanning direction Y and the main scanning direction X the printheads 4 can completely scan the receiving material 3. The scanning carriage is in sliding connection with the guide system via four supports 9 which are operatively connected to the four outermost corners of the scanning carriage. Each of these supports is provided with a piezo-actuator by means of which the scanning carriage can be displaced with respect to the rods 7 and 8. In this way the scanning carriage can be moved in translation in the sub-scanning direction Y but can also be rotated in the plane XY. A rotation in a plane perpendicular to the direction X is also possible. In this way it is possible to obtain any required correction of a deviation in the guidance of the scanning carriage 5.

Each of the four printheads comprises a large number of print elements (not shown) each comprising an ink duct provided with a nozzle. Each ink duct is provided with means for rapidly increasing the pressure in that duct. In this embodiment, such means comprises a thermal element (not shown). By actuation of this element a gas bubble suddenly forms in the duct. As a result of the pressure rise occurring as a consequence, a drop of ink is ejected through the nozzle in the direction of the receiving material 3. This type of printer, to which the invention is not limited, is known as a bubble jet printer. If the thermal elements of each of the printheads are energized image-wise during the movement of the scanning carriage and the receiving material with respect to one another, a color image forms which is built up from individual ink drops on the receiving material. When a receiving material is printed with an inkjet printer of this kind, the said receiving material, or part thereof, is divided up into fixed locations which form a regular field of pixel rows and pixel columns. In this embodiment, the pixel rows extending in the main scanning direction are perpendicular to the pixel columns extending in the sub-scanning direction. The resulting separate locations can each be provided with one or more ink drops. The number of locations per unit of length is termed the resolution of the printed image and is indicated, for example, as 400×600 d.p.i. ("dots per inch").

Figure 2:
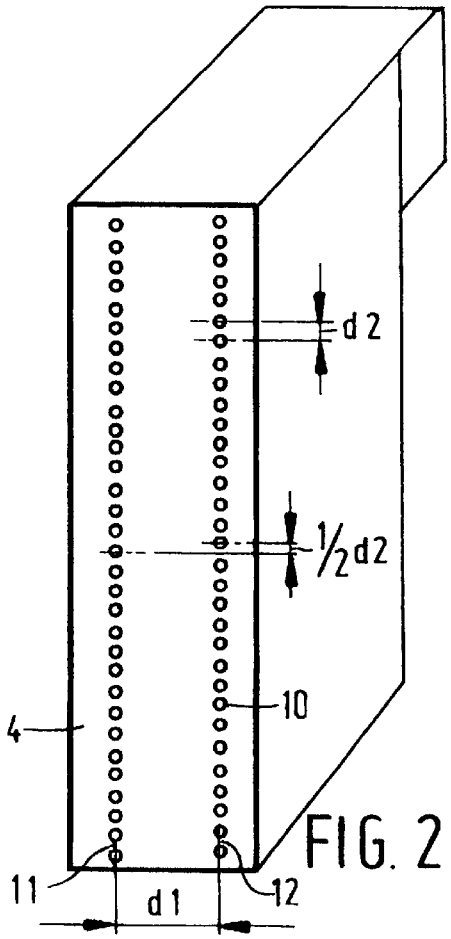
FIG. 2 shows the front of a printhead in a greatly enlarged scale.

In FIG. 2, the front of a printhead 4 is provided with a number of nozzles 10 which are shown highly magnified. In a practical embodiment, the number of nozzles will be even larger, typically 200–300 per printhead. In this example, the printhead 4 comprises two rows of nozzles 11 and 12 spaced by the distance d1 (typically a few millimeter) from one another. The nozzles within one row are spaced apart by a distance d2 equal to $1/300^{th}$ inch. This means that the resolution of a row of nozzles is 300 nozzles per inch (npi). By moving both rows with respect to one another so that consecutive nozzles are spaced apart by a distance one-half d2 (in the direction mainly parallel to the rows) the resulting printhead has a resolution of 600 npi.

Figure 3:
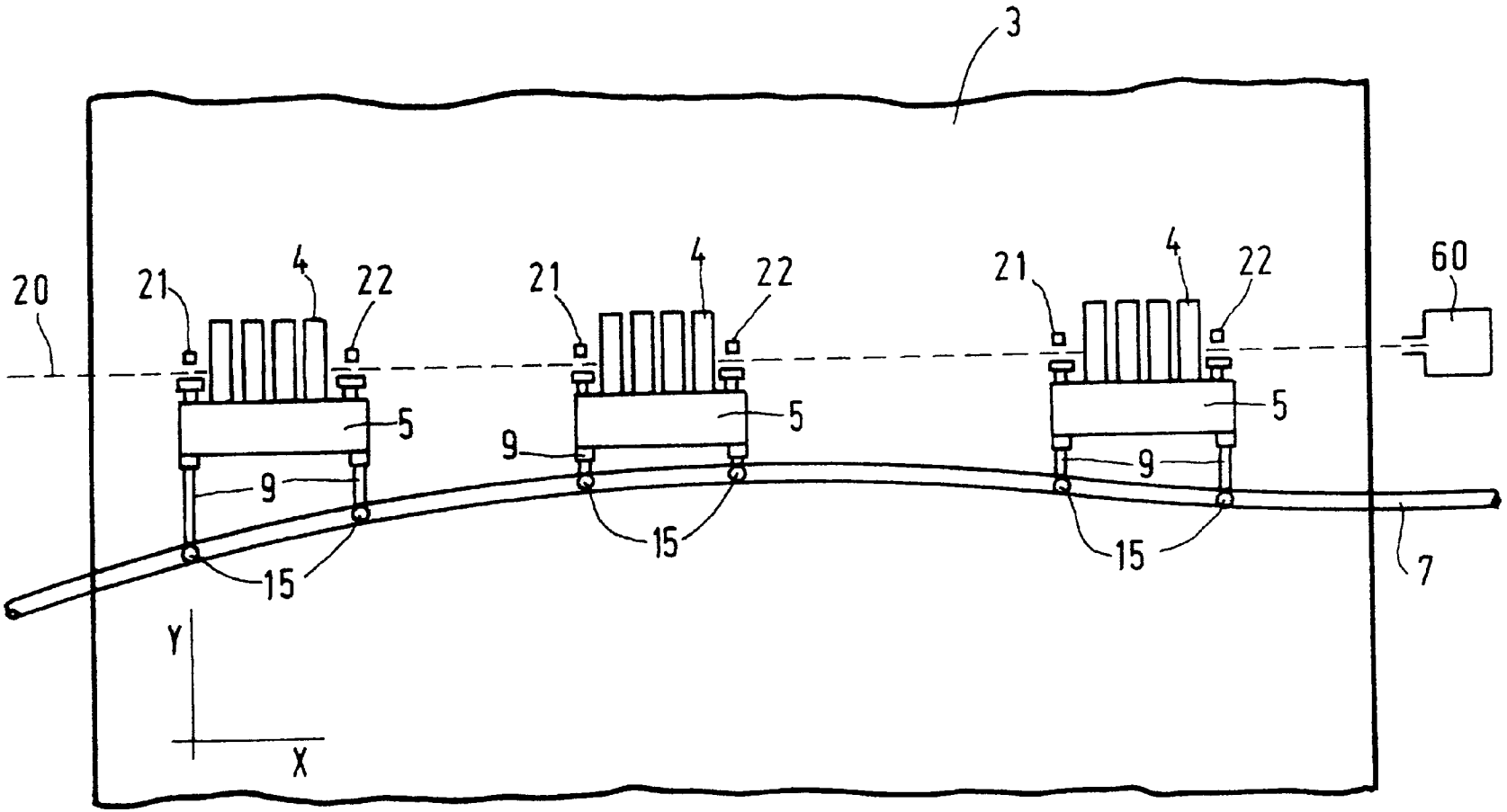
FIG. 3 is a diagram showing the correction of the scanning carriage in a sub-scanning direction.

FIG. 3 diagrammatically illustrates the correction of the scanning carriage 5 in the sub-scanning direction. This Figure shows a single rod 7 serving as a guide for the scanning carriage 5 provided with four printheads 4. The rod 7 is not exactly straight, and this is shown on a greatly exaggerated scale in the drawing. Going from left to right in the drawing, three positions of the scanning carriage 5 are shown during one scanning pass with respect to the receiving material 3. Since the rod 7 is not straight, if a known printer were used, the scanning carriage 5 would perform a wave motion with respect to the receiving material 3 so that printing artifacts would form in the printed image. However, the printer as illustrated is provided with a displacement means to displace the scanning carriage 5 in the sub-scanning direction Y. In this example, the displacement means comprises supports 9, each provided with piezo-actuators (not shown). The supports 9 are connected by bearings 15 to rod 7. The bearings 15 permit a movement substantially free from play by the supports 9 with respect to the rod 7 in each direction. This prevents any mechanical stresses from forming between the scanning carriage 5 and the rod 7.

In this printer, the position of the scanning carriage 5 during a scanning pass is always monitored. For this purpose, the scanning carriage 5 is provided with two sensors 21 and 22. By means of each of these sensors the position of the scanning carriage 5 is measured with respect to a reference line 20. In this printer, this line is formed by a laser beam which is projected from laser gun 60. The laser beam 20 continues during printing. As a result, the position of the scanning carriage 5 can be measured at any time. If a sensor shows that the scanning carriage 5 occupies a deviant position with respect to the laser beam 20, the sensor emits a signal corresponding to that deviation so that the corresponding actuator is energised. As a result, the scanning carriage 5 is displaced with respect to the guide means 7 so that it again follows the reference line 20. A first position of the scanning carriage 5 with respect to the rod 7 is shown on the left in the drawing. Due to the relatively considerable curvature of the rod 7 the piezo-electric actuators of the left-hand support 9 are so energised as to give a relatively considerable deflection. Only in this way is it possible to achieve a good position with respect to the laser beam 20. A second position of the scanning carriage 5 is shown in the middle. Here the deviation of the rod 7 is so small that the piezo-actuators of the supports 9 are hardly deflected, if at all. On the right in the drawing a third position is shown in which the actuators are energised so that the scanning carriage 5 is displaced with respect to the rod 7. In this way, the scanning carriage 5 occupies a substantially constant position in the sub-scanning direction. As a result, the printheads 4 also occupy the most constant position possible with respect to the receiving material 3, and this minimizes the risk of printing artifacts.

The present invention is not restricted to a printer in which the displacement of the scanning carriage with respect to the guide means is monitored by a laser beam. It is also possible to use a metal strip as reference line, the sensor operating optically, magnetically, ultrasonically or in some other way. Other ways, contact or non-contact, which are adequately known from the prior art, can also be used in the printer according to the present invention.

In another embodiment, the position of the scanning carriage is measured with respect to the receiving material and/or the feed surface in order to be able to correct any deviations in the flat attitude of the receiving material. In combination with a correction in the sub-scanning direction and adjustment of the scanning carriage speed or jet moment, it is possible to correct any deviations in any direction.

It is not necessary to measure the position of the scanning carriage on each scanning pass in each printer and displace the scanning carriage in dependence thereon with respect to the guide means. It is quite possible that only fixed deviations, for example, an initial curvature of a guide rod or a curvature of the feed surface, will result in visible printing artifacts. In this case, a single measurement of the deviation over the length of the scanning path in the main scanning direction is sufficient. It would be possible to carry out this measurement after assembly of the printer, whereupon the resulting data are stored in a memory of the printer. Thereafter, on each scanning pass of the scanning carriage in the main scanning direction the said data can be used to displace the scanning carriage with respect to the guide means in order to avoid printing artifacts.

Figure 4:
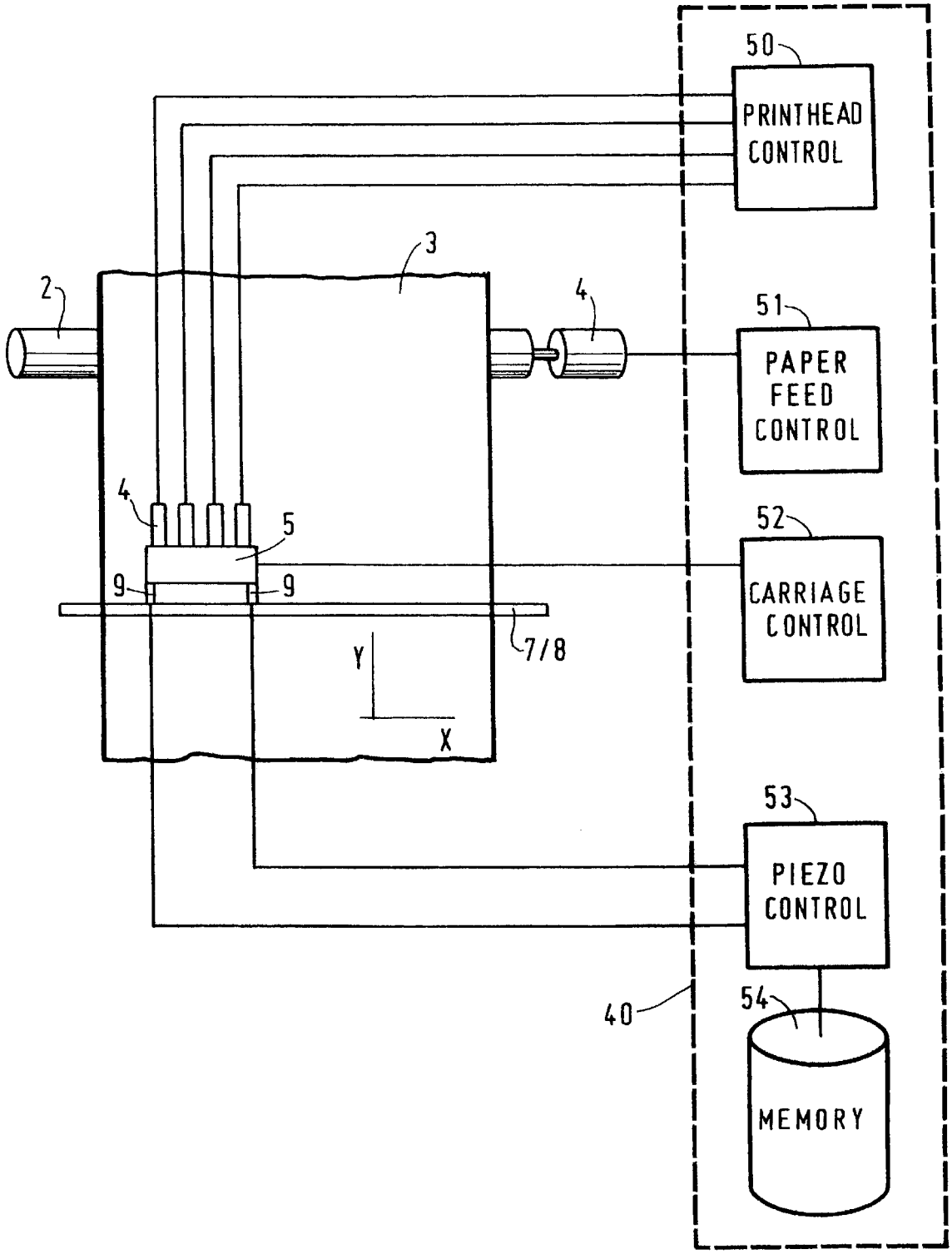
FIG. 4 is a block diagram of the printer.

FIG. 4 is a block diagram of the printer. As shown in the drawing, a control unit 40 of the printer comprises a printhead control block 50, a paper transport control block 51, a scanning carriage control block 52 and a piezo control block 53. In this embodiment the unit 40 is constructed as a microcomputer which is programmed to perform the functions symbolically shown by means of the blocks 50 to 53. The paper transport control block 5 controls the operation of a receiving material transport system which in this embodiment comprises a roller 2 driven by a motor 4 for transport of a receiving material 3 in the sub-scanning direction Y. The scanning carriage control block 52 controls the actuation of a scanning means (not shown), more particularly a conveyor belt, for the reciprocation of the scanning carriage 5 in the main scanning direction X over the guide means formed by rods 7 and 8. The piezo control block 53 controls the actuation of the piezo actuators (not shown) in the supports 9 of the scanning carriage. In the embodiment illustrated, for this actuation during a movement of the scanning carriage in the main scanning direction, use is made of data stored in a memory 54 forming part of control unit 40. These data are obtained by measuring once and for all the net deviation in the guidance of the scanning carriage over the total scanning length. The printhead control block 50 controls the individual nozzles (not shown) of each of the four printheads 4 during the movement of the scanning carriage 5 so that an image can be formed on the receiving material 3.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a scanning carriage, a printhead fixed on the scanning carriage, moving means for moving the scanning carriage and a receiving material with respect to one another in a main scanning direction and in a sub-scanning direction, which is substantially perpendicularly to the main scanning direction, and a guide means for guiding the scanning carriage in the main scanning direction wherein the printer comprises displacement means for displacing the scanning carriage automatically with respect to the guide means in a direction substantially perpendicular to the main scanning direction during the movement of the scanning carriage in the said main scanning direction.

2. The printer according to claim 1, wherein the scanning carriage is displaceable in the sub-scanning direction using the displacement means.

3. The printer according to claim 2, wherein the scanning carriage is displaceable in such a manner that it occupies a substantially constant position in the sub-scanning direction.

4. The printer according to claim 1, wherein at least two printheads are fixed on the scanning carriage.

5. The printer according to claim 1, wherein the printer is adapted to print wideformat receiving materials.

6. The printer according to claim 1, wherein the displacement means comprises two actuators operatively connected to the scanning carriage and the guide means.

7. The printer according to claim 1, wherein the scanning carriage is displaceable, using the displacing means, in a direction substantially perpendicular to the main scanning direction and the sub-scanning direction.

8. The printer according to claim 1, wherein the printhead is releasably fixed on the scanning carriage.

* * * * *